US012660951B1

(12) United States Patent
Smith

(10) Patent No.: US 12,660,951 B1
(45) Date of Patent: Jun. 23, 2026

(54) REVERSIBLE BLANKET WITH LIMB GAPS

(71) Applicant: Daniel Smith, Charlotte, NC (US)

(72) Inventor: Daniel Smith, Charlotte, NC (US)

( * ) Notice: Subject to any disclaimer, the term of this patent is extended or adjusted under 35 U.S.C. 154(b) by 4 days.

(21) Appl. No.: 18/802,025

(22) Filed: Aug. 13, 2024

(51) Int. Cl.
*A47G 9/06* (2006.01)

(52) U.S. Cl.
CPC ..... *A47G 9/066* (2013.01)

(58) Field of Classification Search
CPC .... A47G 9/0223; A47G 9/066; A47G 9/0207; A47G 9/0215; A47G 9/04; A47G 9/062; A47G 9/064; A47G 9/068; A47G 2200/16; A47G 9/0238; A47G 9/0261; A47G 9/06; A47G 9/08; A47G 9/1045; A47G 9/1081; A47G 9/086; A41B 13/06; A41B 2300/32; A41D 15/04; A41D 1/00; A41D 1/002; A41D 13/1272; A41D 27/20; A41D 3/08
USPC ..... 5/482, 417, 485, 413 R, 419, 420, 494, 5/495, 496; 2/69.5, 69, 53, 59
See application file for complete search history.

(56) References Cited

U.S. PATENT DOCUMENTS

| | | | | |
|---|---|---|---|---|
| 4,631,765 | A | 12/1986 | Casey | |
| 7,594,287 | B2 | 9/2009 | Framer | |
| 9,439,463 | B1 | 9/2016 | Spears | |
| D791,511 | S | 7/2017 | Walker | |
| 10,874,230 | B2 | 12/2020 | Green | |
| 2003/0046763 | A1* | 3/2003 | Chancey | A47D 15/006 5/482 |
| 2004/0019969 | A1* | 2/2004 | Gatten | A41B 13/06 2/69.5 |
| 2006/0174409 | A1 | 8/2006 | Hermanson | |
| 2008/0120774 | A1* | 5/2008 | Hite | A47G 9/0223 5/494 |
| 2011/0179559 | A1 | 7/2011 | Smoot | |
| 2017/0295961 | A1 | 10/2017 | Alletto | |
| 2019/0208933 | A1 | 7/2019 | Ropchan | |

FOREIGN PATENT DOCUMENTS

| | | |
|---|---|---|
| WO | 2018017486 | 1/2018 |

OTHER PUBLICATIONS

Flo Blanket (NPL—Kickstart Website—"Flo Blanket: The Evolution of Comfort", Date: Feb. 28, 2023, www.merriam-webster.com/dictionary/pipe. (Year: 2023).*
Now on Kickstarter: Flo Blanket: The Evolution of Comfort, YouTube, Date: Sep. 15, 2022, www.youtube.com/watch?v=YwVqXlcjkPU (Year: 2022).*

* cited by examiner

*Primary Examiner* — Madison Matthews
(74) *Attorney, Agent, or Firm* — Kyle A. Fletcher, Esq.

(57) ABSTRACT

The reversible blanket with limb gaps may include a first blanket panel, a second blanket panel, and a third blanket panel that may be coupled to form a blanket. The first blanket panel may overlap the second blanket panel to form a first overlap. The second blanket panel may overlap the third blanket panel to form a second overlap. A plurality of seams on the first overlap and the second overlap may create a plurality of gaps where an object may pass through the blanket. The blanket may be adapted to cover a user. The plurality of gaps may be adapted to pass a user's arms through the blanket so that a user's hands may be used in front of the blanket. The blanket may be reversible to change the appearance of the blanket.

19 Claims, 5 Drawing Sheets

REVERSIBLE BLANKET WITH LIMB GAPS

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the fields of blankets and personal wraps, more specifically, a reversible blanket with limb gaps.

SUMMARY OF INVENTION

The reversible blanket with limb gaps may comprise a first blanket panel, a second blanket panel, and a third blanket panel that may be coupled to form a blanket. The first blanket panel may overlap the second blanket panel to form a first overlap. The second blanket panel may overlap the third blanket panel to form a second overlap. A plurality of seams on the first overlap and the second overlap may create a plurality of gaps where an object may pass through the blanket. The blanket may be adapted to cover a user. The plurality of gaps may be adapted to pass a user's arms through the blanket so that a user's hands may be used in front of the blanket. The blanket may be reversible to change the appearance of the blanket.

An object of the invention is to provide a blanket comprising three panels that create a first overlap and a second overlap.

Another object of the invention is to provide a plurality of seams located on the first overlap and the second overlap, said plurality of seams creating a plurality of upper gaps at the first overlap and a plurality of lower gaps at the second overlap with the plurality of upper gaps operable to pass a user's arms through the blanket.

A further object of the invention is to provide an obverse side on each of the three panels and a reverse side on each of the three panels.

Yet another object of the invention is to rotate the blanket 180 degrees about a lateral center axis to reverse the blanket front to rear and top to bottom in order to change the appearance of the blanket such that the user's arms may pass through the plurality of lower gaps of the reversed blanket.

These together with additional objects, features and advantages of the reversible blanket with limb gaps will be readily apparent to those of ordinary skill in the art upon reading the following detailed description of the presently preferred, but nonetheless illustrative, embodiments when taken in conjunction with the accompanying drawings.

In this respect, before explaining the current embodiments of the reversible blanket with limb gaps in detail, it is to be understood that the reversible blanket with limb gaps is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the reversible blanket with limb gaps.

It is therefore important that the claims be regarded as including such equivalent construction insofar as they do not depart from the spirit and scope of the reversible blanket with limb gaps. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
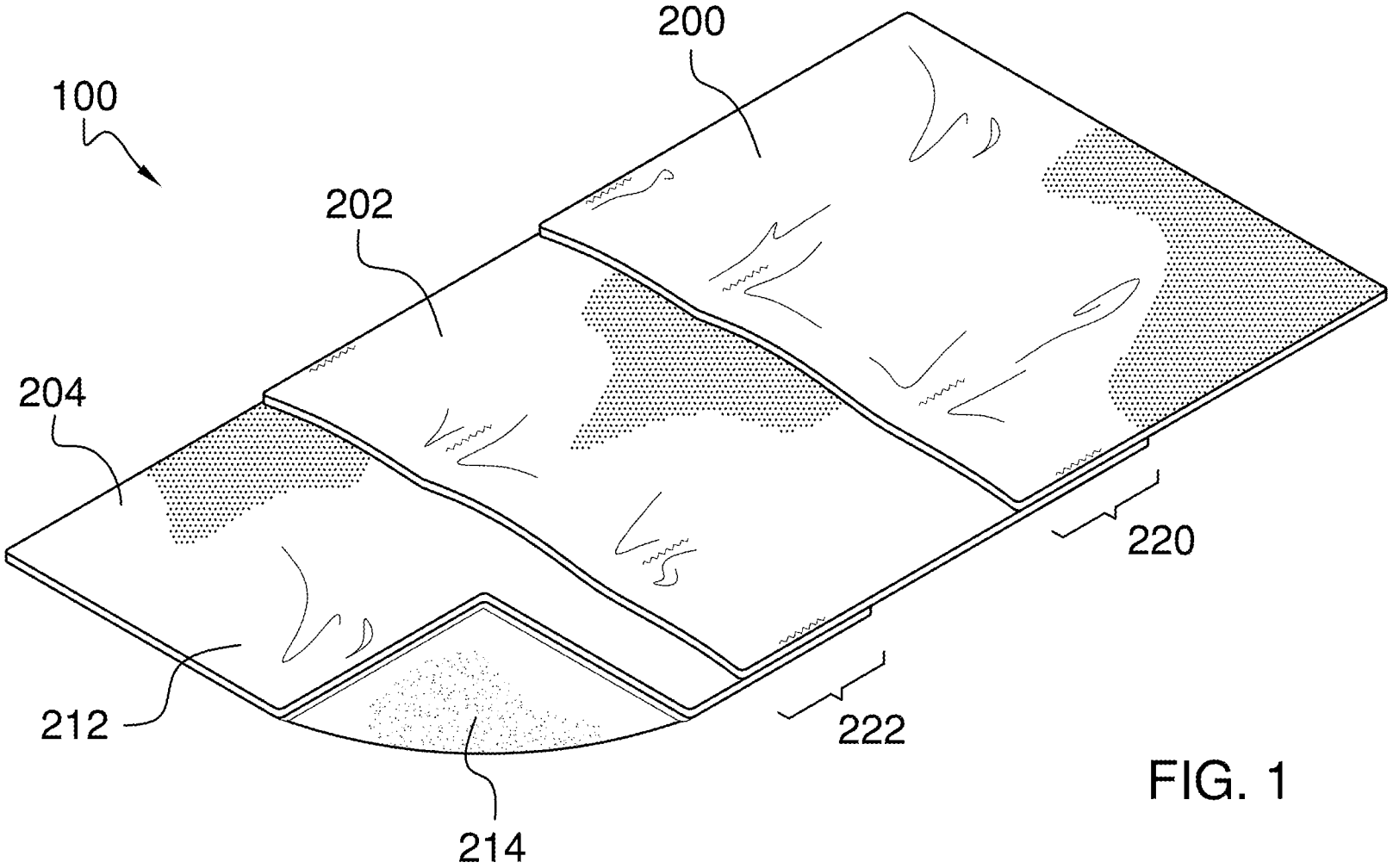
FIG. 1 is an isometric view of an embodiment of the disclosure.
Figure 2:
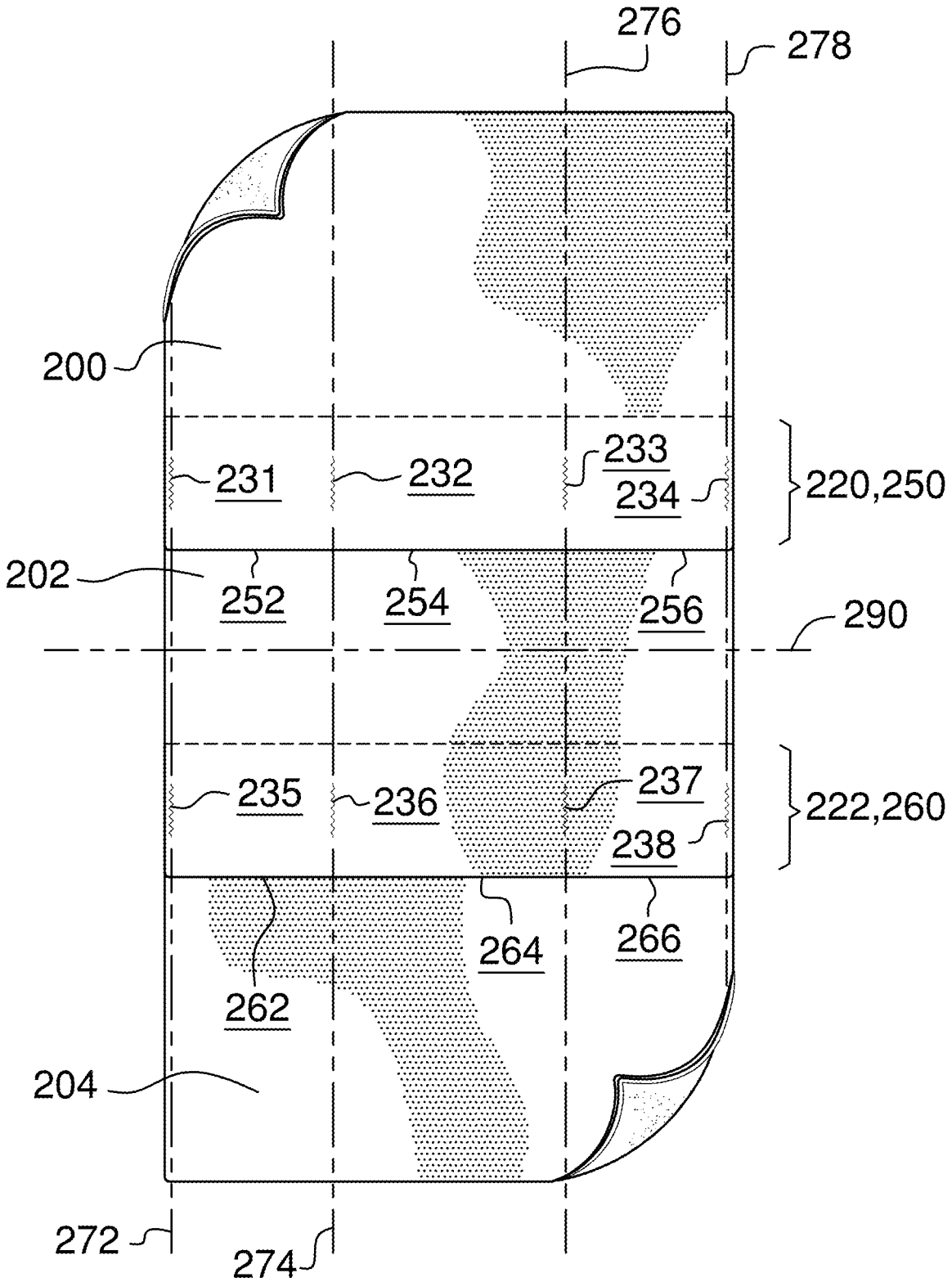
FIG. 2 is a front view of an embodiment of the disclosure.
Figure 3:
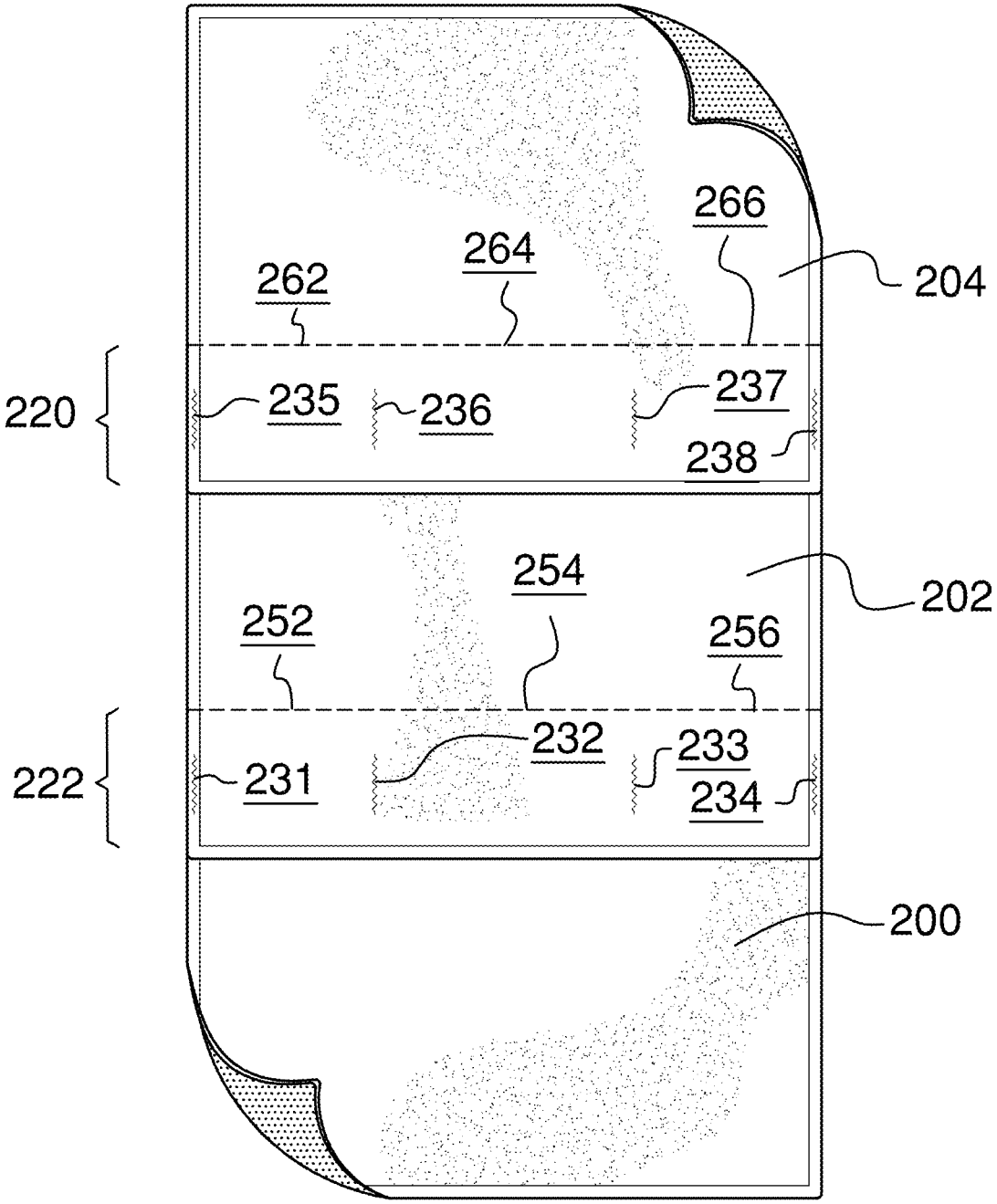
FIG. 3 is a rear view of an embodiment of the disclosure.
Figure 4:
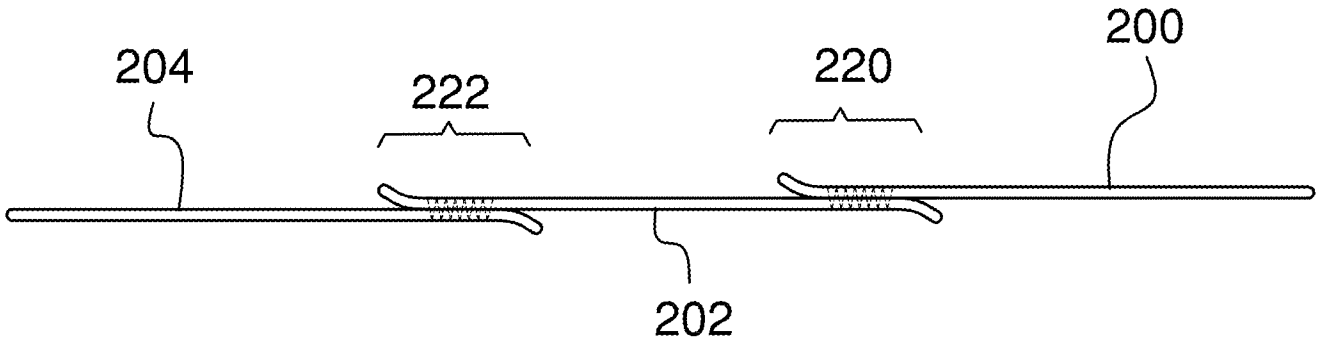
FIG. 4 is a side view of an embodiment of the disclosure.
Figure 5:
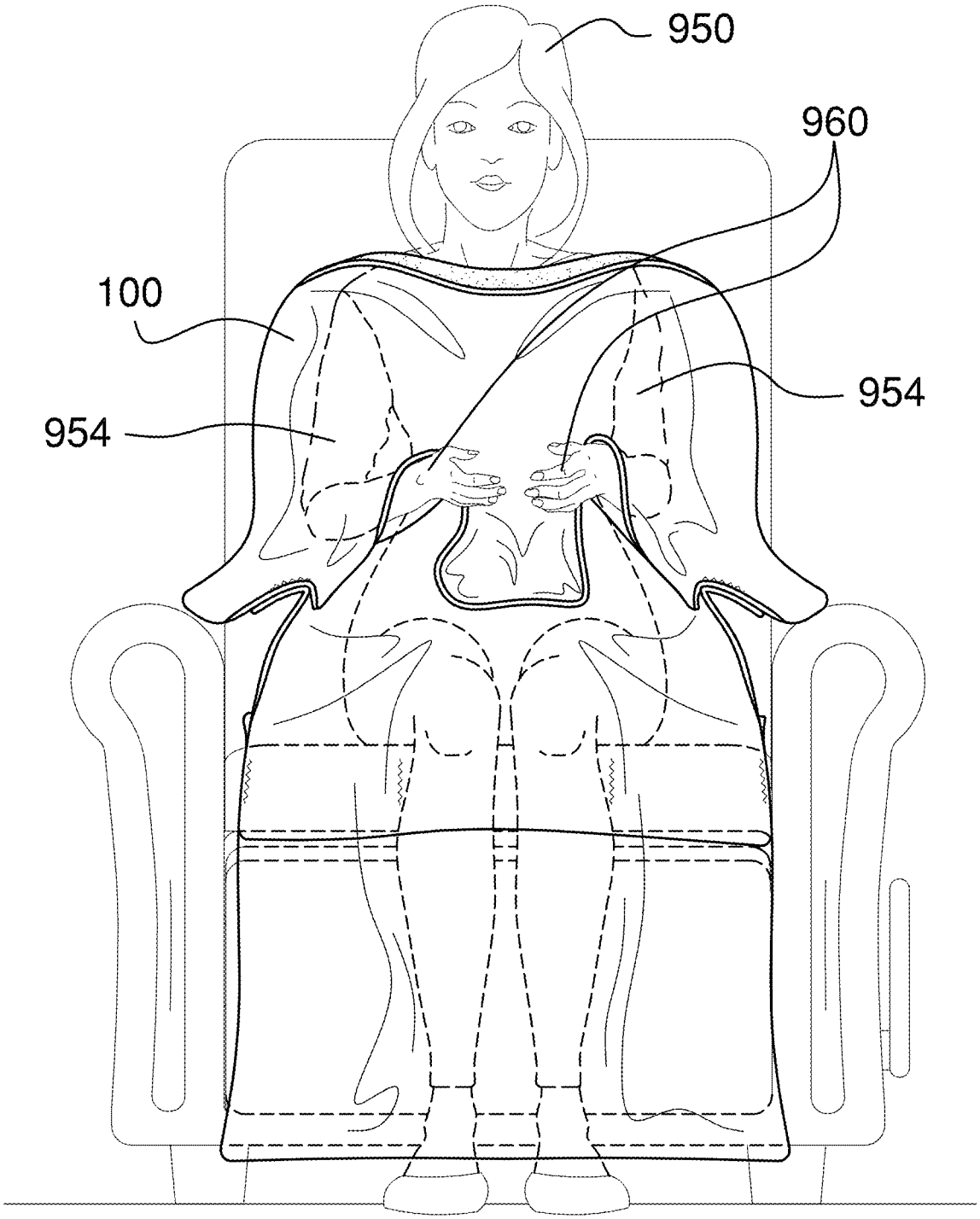
FIG. 5 is an in-use view of an embodiment of the disclosure.

Detailed reference will now be made to a first potential embodiment of the disclosure, which is illustrated in FIGS. 1 through 5.

The reversible blanket with limb gaps 100 (hereinafter invention) comprises a first blanket panel 200, a second blanket panel 202, and a third blanket panel 204 that may be coupled to form a blanket.

As a side note, the invention 100 may include a plurality of blanket panels 600. This infers that the number of blanket panels may involve 2 panels, or four or more panels. The intent is to not limit the scope of the patent to any specific number of blanket panels. The patent figures and description below are provided as an example of one particular embodiment of the invention 100.

The first blanket panel 200 may overlap the second blanket panel 202 to form a first overlap 220. The second blanket panel 202 may overlap the third blanket panel 204 to form a second overlap 222. A plurality of seams on the first overlap 220 and the second overlap 222 may create a plurality of gaps where an object may pass through the blanket. The blanket may be adapted to cover a user 950. The plurality of gaps may be adapted to pass a user's arms 954 through the blanket so that a user's hands 960 may be used in front of the blanket. The blanket may be reversible to change the appearance of the blanket.

The first blanket panel 200, the second blanket panel 202, and the third blanket panel 204 may be flexible panels made of one or more fabrics. An individual panel selected from the first blanket panel 200, the second blanket panel 202, and the third blanket panel 204 may comprise an obverse side 212 and a reverse side 214. The obverse side 212 may be considered to be the front of the individual panel and the reverse side 214 may be considered to be the rear of the individual panel. The obverse side 212 may present a first appearance and the reverse side 214 may present a second appearance. In a preferred embodiment, the first appearance may be different from the second appearance. As non-limiting examples, the first appearance and the second appearance may differ due to coloring, pattern, texture, material, and any combination thereof.

The first blanket panel 200, the second blanket panel 202, and the third blanket panel 204 may collectively be referred to as the three panels. The first appearance of the obverse side 212 of the three panels may be the same, the first appearance of the obverse side 212 of the three panels may differ, the second appearance of the reverse side 214 of the three panels may be the same, the second appearance of the reverse side 214 of the three panels may differ, or any combination thereof.

The bottom of the first blanket panel 200 may cover the top of the second blanket panel 202 to form the first overlap 220. The bottom of the second blanket panel 202 may cover the top of the third blanket panel 204 to form the second overlap 222. As non-limiting examples, the first overlap 220 and the second overlap 222 may overlap by approximately 4 inches.

The plurality of seams may be positioned on the first overlap 220 and the second overlap 222 along a plurality of longitudinal seam lines. As a side note, the plurality of seams may be positioned along vertical seam lines in lieu of horizontal seam lines. This patent application is not to be limited to any specific orientation.

The plurality of longitudinal seam lines, comprising a first longitudinal seam line 272, a second longitudinal seam line 274, a third longitudinal seam line 276, and a fourth longitudinal seam line 278, may run along the blanket longitudinally from top to bottom. The first longitudinal seam line 272 may be located adjacent to the left edge of the blanket. The fourth longitudinal seam line 278 may be located adjacent to the right edge of the blanket. The second longitudinal seam line 274 may be located to the right of the first longitudinal seam line 272 and may be separated from the first longitudinal seam line 272 by a distance that is less than one half of lateral width of the blanket. The third longitudinal seam line 276 may be located to the left of the fourth longitudinal seam line 278 and may be separated from the fourth longitudinal seam line 278 by a distance that is less than one half of lateral width of the blanket.

Four seams may be located on the first overlap 220 and four seams may be located on the second overlap 222. A first seam 231 may be positioned on the first overlap 220 along the first longitudinal seam line 272. A second seam 232 may be positioned on the first overlap 220 along the second longitudinal seam line 274. A third seam 233 may be positioned on the first overlap 220 along the third longitudinal seam line 276. A fourth seam 234 may be positioned on the first overlap 220 along the fourth longitudinal seam line 278. A fifth seam 235 may be positioned on the second overlap 222 along the first longitudinal seam line 272. A sixth seam 236 may be positioned on the second overlap 222 along the second longitudinal seam line 274. A seventh seam 237 may be positioned on the second overlap 222 along the third longitudinal seam line 276. An eighth seam 238 may be positioned on the second overlap 222 along the fourth longitudinal seam line 278.

An individual seam selected from the plurality of seams may be stitched, adhered, stapled, heat sealed, bonded, or any combination thereof.

The plurality of gaps created by the plurality of seams may comprise a plurality of upper gaps 250 and a plurality of lower gaps 260. The plurality of upper gaps 250 may be located at the first overlap 220 between the first blanket panel 200 and the second blanket panel 202. The plurality of lower gaps 260 may be located at the second overlap 222 between the second blanket panel 202 and the third blanket panel 204.

The plurality of upper gaps 250 may comprise a first upper gap 252, a second upper gap 254, and a third upper gap 256. The first upper gap 252 may be located between the first seam 231 and the second seam 232. The second upper gap 254 may be located between the second seam 232 and the third seam 233. The third upper gap 256 may be located between the third seam 233 and the fourth seam 234.

The plurality of lower gaps 260 may comprise a first lower gap 262, a second lower gap 264, and a third lower gap 266. The first lower gap 262 may be located between the fifth seam 235 and the sixth seam 236. The second lower gap 264 may be located between the sixth seam 236 and the seventh seam 237. The third lower gap 266 may be located between the seventh seam 237 and the eighth seam 238.

The blanket may be adapted for the user 950 to place the user's arms 954 or other limbs through two of the plurality of gaps while the blanket covers the user 950. As a non-limiting example, the user 950 may place the user's arms 954 through two of the plurality of upper gaps 250.

The blanket may be reversed by rotating the blanket by 180 degrees around a lateral center axis 290 of the blanket. The blanket may be rotationally symmetrical such that a reversed blanket resulting from such a rotation retains the shape of a non-reversed blanket. The reversed blanket may display the second appearance of the reverse side 214 in place of the first appearance of the obverse side 212.

In use, a user 950 may cover themselves with the blanket while seated. The blanket may present a first appearance defined by the obverse sides 212 of the three panels comprising the blanket. The user's arms 954 may extend through the plurality of upper gaps 250 such that the user's hands 960 are free to hold a book, operate a remote control, knit, or perform other tasks. The user 950 may rotate the blanket around the lateral center axis 290 to present a second appearance defined by the reverse sides 214 of the three panels. The rotation may have the effect of reversing the blanket front to rear and top to bottom. The plurality of lower gaps 260 may be located above the plurality of upper gaps 250 after the rotation. The user 950 may sit and the user's arms 954 may extend through the plurality of lower gaps 260 to perform tasks in front of the reversed blanket.

Definitions

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" may refer to top and "lower" may refer to the bottom. As a non-limiting example, the upper end of a vertical shaft is the top end of the vertical shaft.

As used herein, "approximate" and "approximately" indicate that information that is being presented is not critical for proper functioning of the invention and that the information is being provided only to assist in a better understanding of some physical characteristic of an embodiment of the invention. As a non-limiting example, a device that is described as "cubical and approximately 1 inch long on each side" is not required to be precisely 1 inch long on each side and the reader may understand that the device will likely fit in their pocket.

As used herein, the words "couple", "couples", "coupled" or "coupling", may refer to connecting, either directly or indirectly, and does not necessarily imply a mechanical connection.

As used in this disclosure, "flexible" may refer to an object or material which will deform when a force is applied to it, which will not return to its original shape when the deforming force is removed, and which may not retain the deformed shape caused by the deforming force.

As used herein, "front" may indicate the side of an object that is closest to a forward direction of travel under normal use of the object or the side or part of an object that normally presents itself to view or that is normally used first. "Rear" or "back" may refer to the side that is opposite the front.

As used in this disclosure, the word "lateral" may refer to the sides of an object or movement towards a side. Lateral directions are generally perpendicular to longitudinal directions. "Laterally" may refer to movement in a lateral direction. "Lateral axis" may refer to an axis that extends in a lateral direction.

As used herein, "rotationally symmetrical" may refer to an object that retains the same shape when rotated by less than 360 degrees around an axis of the object.

As used in this disclosure, a "seam" may be a joining of: 1) a first textile to a second textile; 2) a first sheeting to a second sheeting; or, 3) a first textile to a first sheeting. Potential methods to form seams include, but are not limited to, a sewn seam, a heat bonded seam, an ultrasonically bonded seam, or a seam formed using an adhesive.

As used in this disclosure, "texture" may refer to a tactile or three dimensional characteristic of a surface.

With respect to the above description, it is to be realized that the optimum dimensional relationship for the various components of the invention described above and in FIGS. 1 through 5, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A reversible blanket with limb gaps comprising:

a plurality of blanket panels are coupled to form the reversible blanket;

wherein the reversible blanket is adapted to cover a user;

wherein the plurality of blanket panels are horizontally orient, and overlap one another in order to form a plurality of gaps;

wherein the plurality of gaps are adapted to pass an arm of a user through the reversible blanket so that the hands of the user are usable in front of the reversible blanket;

wherein the reversible blanket is reversible to change an appearance of the reversible blanket;

wherein the plurality of blanket panels is further defined as four or more panels.

2. The reversible blanket with limb gaps according to claim 1 wherein the plurality of blanket panels is further defined as a first blanket panel, a second blanket panel, and a third blanket panel;

wherein the first blanket panel, the second blanket panel, and the third blanket panel are coupled to form the reversible blanket;

wherein the first blanket panel overlaps the second blanket panel to form a first overlap;

wherein the second blanket panel overlaps the third blanket panel to form a second overlap;

wherein a plurality of seams on the first overlap and the second overlap create the plurality of gaps operable to pass an object through the reversible blanket.

3. The reversible blanket with limb gaps according to claim 2 wherein the first blanket panel, the second blanket panel, and the third blanket panel are flexible panels made of one or more fabrics.

4. The reversible blanket with limb gaps according to claim 3 wherein an individual panel selected from the first blanket panel, the second blanket panel, and the third blanket panel comprise an obverse side and a reverse side;

wherein the obverse side defines the front of the individual panel and the reverse side defines the rear of the individual panel.

5. The reversible blanket with limb gaps according to claim 4 wherein the obverse side presents a first appearance and the reverse side presents a second appearance.

6. The reversible blanket with limb gaps according to claim 5 wherein the first appearance is different from the second appearance.

7. The reversible blanket with limb gaps according to claim 6 wherein the first appearance and the second appearance differ due to coloring, pattern, texture, material, and any combination thereof.

8. The reversible blanket with limb gaps according to claim 5 wherein the first blanket panel, the second blanket panel, and the third blanket panel are collectively referred to as three panels;

wherein the first appearance of the three panels is the same, the first appearance of the three panels differ, the second appearance of the three panels is the same, the second appearance of the three panels differ, or any combination thereof.

9. The reversible blanket with limb gaps according to claim 8 wherein the bottom of the first blanket panel covers the top of the second blanket panel to form the first overlap;

wherein the bottom of the second blanket panel covers the top of the third blanket panel to form the second overlap.

10. The reversible blanket with limb gaps according to claim 9 wherein the plurality of seams are positioned on the first overlap and the second overlap along a plurality of longitudinal seam lines;

wherein the plurality of longitudinal seam lines comprise a first longitudinal seam line, a second longitudinal seam line, a third longitudinal seam line, and a fourth longitudinal seam line;

wherein the plurality of longitudinal seam lines run along the reversible blanket longitudinally from top to bottom.

11. The reversible blanket with limb gaps according to claim 10 wherein the first longitudinal seam line is located adjacent to a left edge of the reversible blanket;

wherein the fourth longitudinal seam line is located adjacent to a right edge of the reversible blanket;

wherein the second longitudinal seam line is located to a right of the first longitudinal seam line and is separated from the first longitudinal seam line by a distance that is less than one half of lateral width of the reversible blanket;

wherein the third longitudinal seam line is located to a left of the fourth longitudinal seam line and is separated from the fourth longitudinal seam line by a distance that is less than one half of lateral width of the reversible blanket.

12. The reversible blanket with limb gaps according to claim 11 wherein four seams are located on the first overlap and four seams are located on the second overlap.

13. The reversible blanket with limb gaps according to claim 12 wherein a first seam is positioned on the first overlap along the first longitudinal seam line;

wherein a second seam is positioned on the first overlap along the second longitudinal seam line;

wherein a third seam is positioned on the first overlap along the third longitudinal seam line;

wherein a fourth seam is positioned on the first overlap along the fourth longitudinal seam line;

wherein a fifth seam is positioned on the second overlap along the first longitudinal seam line;

wherein a sixth seam is positioned on the second overlap along the second longitudinal seam line;

wherein a seventh seam is positioned on the second overlap along the third longitudinal seam line;

wherein an eighth seam is positioned on the second overlap along the fourth longitudinal seam line.

14. The reversible blanket with limb gaps according to claim 13 wherein an individual seam selected from the plurality of seams is stitched, adhered, stapled, heat sealed, bonded, or any combination thereof.

15. The reversible blanket with limb gaps according to claim 14 wherein the plurality of gaps created by the plurality of seams comprise a plurality of upper gaps and a plurality of lower gaps;

wherein the plurality of upper gaps are located at the first overlap between the first blanket panel and the second blanket panel;

wherein the plurality of lower gaps are located at the second overlap between the second blanket panel and the third blanket panel.

16. The reversible blanket with limb gaps according to claim 15 wherein the plurality of upper gaps comprises a first upper gap, a second upper gap, and a third upper gap;

wherein the first upper gap is located between the first seam and the second seam;

wherein the second upper gap is located between the second seam and the third seam;

wherein the third upper gap is located between the third seam and the fourth seam.

17. The reversible blanket with limb gaps according to claim 16 wherein the plurality of lower gaps comprises a first lower gap, a second lower gap, and a third lower gap;

wherein the first lower gap is located between the fifth seam and the sixth seam;

wherein the second lower gap is located between the sixth seam and the seventh seam;

wherein the third lower gap is located between the seventh seam and the eighth seam.

18. The reversible blanket with limb gaps according to claim 17 wherein the reversible blanket is adapted for the user to place the arm of the user or other limbs through two of the plurality of gaps while the reversible blanket covers the user.

19. The reversible blanket with limb gaps according to claim 18 wherein the reversible blanket is reversed by rotating the blanket by 180 degrees around a lateral center axis of the reversible blanket;

wherein the reversible blanket is rotationally symmetrical such that a reversed blanket resulting from such a rotation retains the shape of a non-reversed blanket;

wherein the reversed blanket displays the second appearance of the reverse side in place of the first appearance of the obverse side.

* * * * *